US005120293A

United States Patent [19]

Franklin

[11] Patent Number: 5,120,293

[45] Date of Patent: Jun. 9, 1992

[54] ERECTION MECHANISM FOR PACKING CASES

[75] Inventor: Kenneth W. Franklin, Leaming Spa, United Kingdom

[73] Assignee: Bishopbarn Limited, United Kingdom

[21] Appl. No.: 758,673

[22] Filed: Sep. 12, 1991

[30] Foreign Application Priority Data

Sep. 14, 1990 [GB] United Kingdom ..... 9020121

[51] Int. Cl.[5] ..... B31B 3/52; B31B 3/80; B31B 5/26

[52] U.S. Cl. ..... 493/125; 493/136; 493/139; 493/183; 493/316

[58] Field of Search ..... 493/123, 125, 126, 136, 493/137, 139, 183, 316

[56] References Cited

U.S. PATENT DOCUMENTS 2,289,820 7/1942 Ardell ..... 493/316
2,782,695 2/1957 Meissner et al. ..... 493/183
4,364,217 12/1982 Torrenteras et al. ..... 493/139
4,579,551 4/1986 Ulrich et al. ..... 493/23
4,584,818 4/1986 Plaskett ..... 493/136

FOREIGN PATENT DOCUMENTS 1313188 11/1962 France ..... 493/136
621 1/1991 Japan ..... 493/316

*Primary Examiner*—William E. Terrell
*Attorney, Agent, or Firm*—Davis, Bujold & Streck

[57] ABSTRACT

A machine for erecting packing cases of a kind comprising two major and two minor sides and four base flaps foldable to form a base comprises supports for holding a folded flat case by its sides and for opening its sides to a rectangular form with the case at a first station, three sequentially operated flap folding elements arranged to fold three of the flaps into the base plane; and a traversable carriage having a guide arranged to engage the other flap as the carriage moves towards the case and to deflect that flap into the base plane in the required sequence.

4 Claims, 4 Drawing Sheets

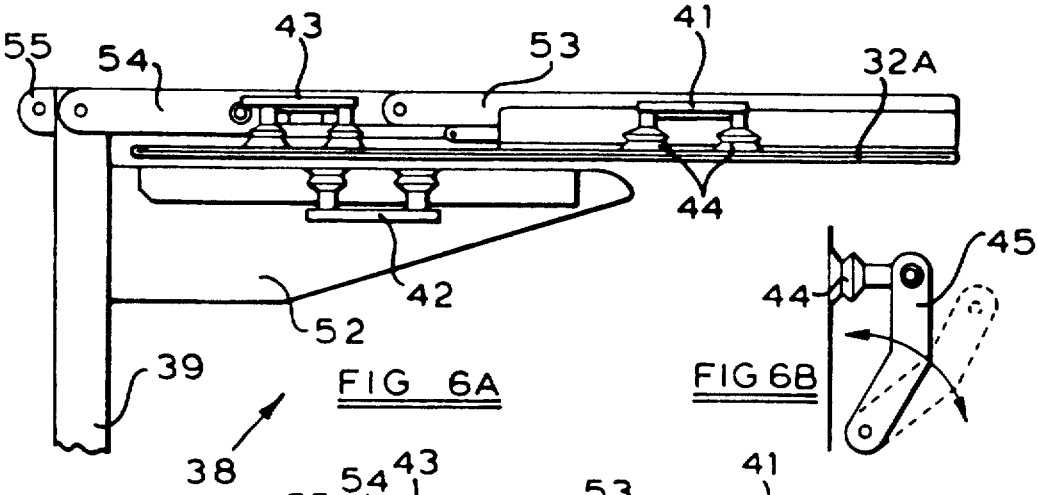
FIG 6A
FIG 6B
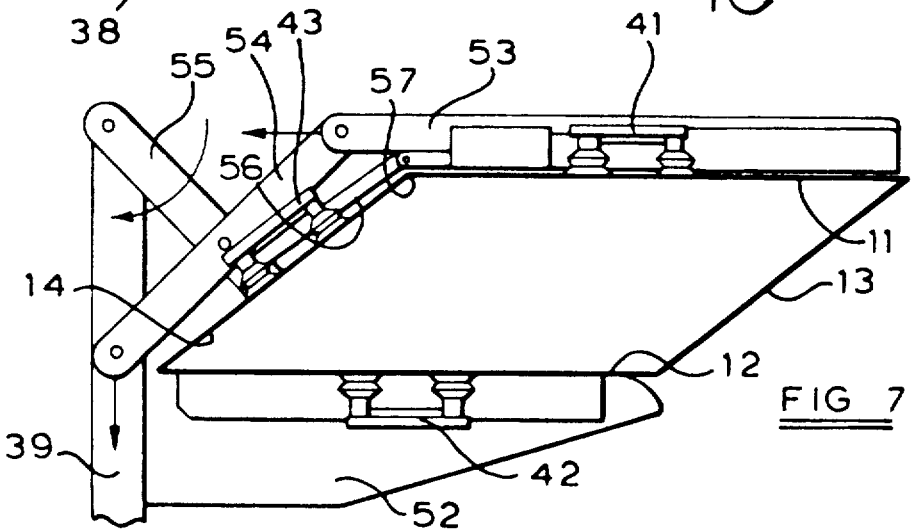
FIG 7
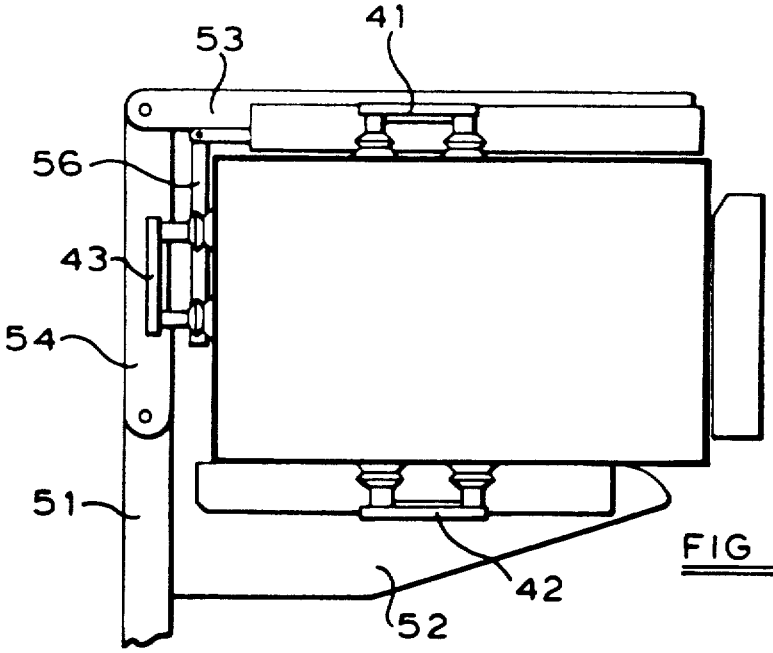
FIG 8

ERECTION MECHANISM FOR PACKING CASES

BACKGROUND TO THE INVENTION

The invention relates to erection mechanisms for packing cases.

In situations where packing cases are to be filled with product at the end of a production line, it is normal practice to have a supply of folded flat packing cases which are erected immediately prior to being filled. The packing cases may be used once only or may be re-usable after product in them has been delivered to its destination. In either situation, the cases are in a folded condition for transport and remain in the folded condition for as long as possible to save space in the packing area.

The kind of case with which the invention is particularly concerned is a foldable packing case having two major and two minor sides effectively hinged together enabling the case to be folded from a flat condition via a parallelogram configuration to a rectangular configuration. The case has two major base flaps and two minor base flaps, each effectively hinged to the bottom edge of a corresponding side with the flaps being shaped for mutual interlocking and being foldable in the sequence of first major flap, both minor flaps and then the second major flap into positions where they interlock and form a base in a base plane generally conforming to the plane including the lower edges of the sides, the second major flap temporarily being folded beyond the base plane to cause said interlocking.

Packing cases of this kind are normally erected by hand by an operative and are then loaded manually into a machine, either directly into a loading station or into a waiting station where they are fed by the machine into the loading station as required.

Automatic case erectors are known but in the past when automatic case erection has been required, base flaps have been secured together to form a base by means other than mutual interlocking, eg. by an adhesive. When the base is built up in this way, it becomes impractical to collapse the case and re-erect it later so such cases are not generally re-usable in a regular production environment.

An objective of the present invention is to provide a machine for automatically erecting packing cases of the kind in which the bases are formed by mutually interlocking flaps.

SUMMARY OF THE INVENTION

In accordance with the present invention a machine for erecting packing cases of the kind referred to comprises a first case station; a second case station adjacent the first station; means for supporting a folded flat case by its sides and opening its sides to a rectangular form with the case at the first station and with a first minor side of the case adjacent the second station; a first flap folding element at the first station arranged to fold the first major flap into the base plane; a second flap folding element at the first station arranged to fold the second minor flap into the base plane; a carriage traversable between the two stations and having a guide on the carriage arranged to engage the first minor flap as the carriage moves towards the first station and to deflect the first minor flap into the base plane; and a third flap folding element arranged to engage the second major flap after the folding of the minor flaps and without interference with the carriage to fold the second major flap through the base plane and up into the case to cause interlocking engagement of the flaps and then to retract to allow the second major flap to return to the base plane, the flap folding elements being retractable to allow the carriage to continue to move under the case to support the base thereof.

By initially supporting the case by its sides, free space is provided below the case for operation of the flap folding elements. Use of a guide fixed to the carriage in place of a flap folding element to fold the second minor flap into the base plane avoids conflicting space requirements for a flap folding element and movement of the carriage.

Preferably the means for supporting a folded flat case by its sides and for opening its sides comprise side supporting elements having suction members for engagement with the sides.

The machine may further comprise a folded case receiving station remote from the first station and adjacent the second station and means for traversing the folded flat case to the first station for engagement with said means for supporting the case by its sides.

Said guide may comprise a curved leading edge to said carriage as it traverses to said first station.

BRIEF DESCRIPTION OF THE DRAWINGS

An embodiment of the invention will now be described by way of example only with reference to the accompanying drawings in which:

FIG. 6A, 6B, 7 and 8 illustrate the transfer mechanism which also opens the case.

DESCRIPTION OF A PREFERRED EMBODIMENT

Figure 1:
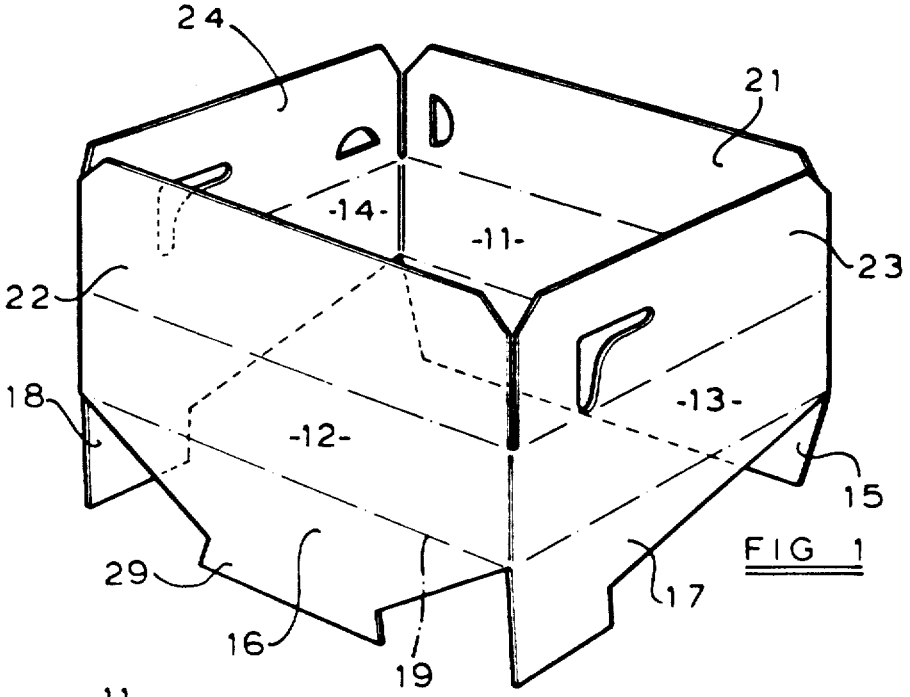
FIG. 1 is a pictorial view of a case used in the present invention.

The packing case shown in FIG. 1 has a first major side 11, a second major side 12, a first minor side 13 and a second minor side 14. The sides are referred to as major and minor sides for convenience and in this typical case the major sides are longer than the minor sides. Each side and each of the flaps which will be described subsequently is formed from laminated corrugated board in the usual way and in practice the case is cut in a single piece. Each side is effectively hinged to its adjacent sides at fold lines in the board. One of these fold lines also incorporates a join between two originally free ends.

The case incorporates first and second major base flaps 15 and 16 and first and second minor base flaps 17 and 18 each of which is effectively hinged about a fold line to the lower edge of its corresponding side. A typical fold line also constituting the lower edge of its side is shown at 19 for side 12. Major and minor top flaps 21, 22 and 23, 24 are also shown in FIG. 1. They can be folded down to form a top closure for the case but will not be described further because their details are not significant to the invention.

Figure 2:
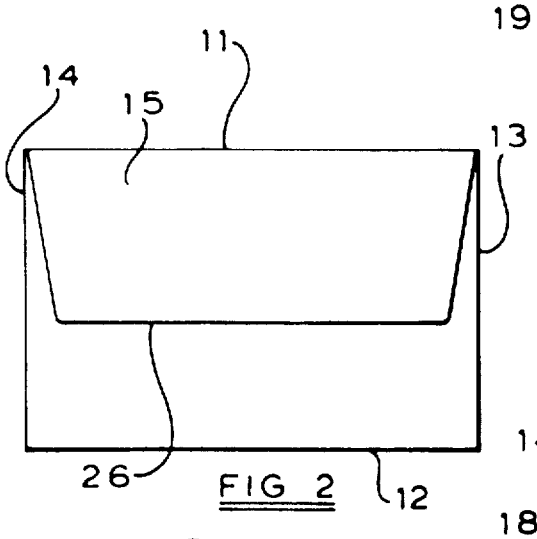
FIGS. 2 to 4 are plan views from above of a case at various stages in formation of its base.
Figure 3:
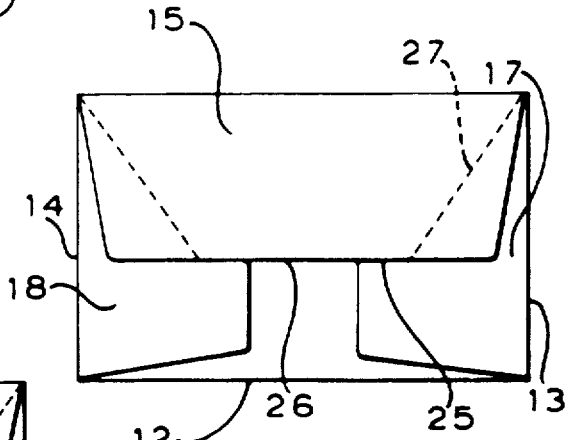
Figure 4:
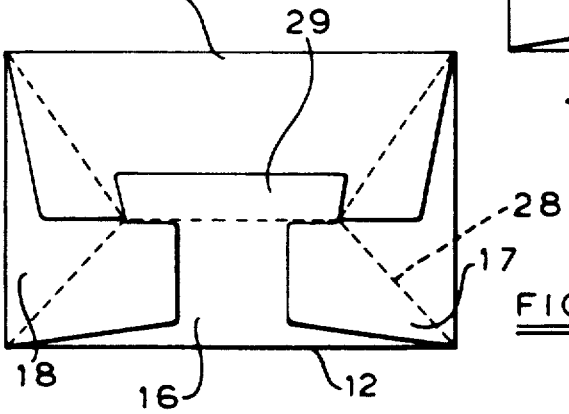

FIGS. 2, 3 and 4 are diagrammatic plan views from above showing the sequence of folding the base flaps to form a base. The first major flap 15 is folded first. This flap is of almost rectangular shape, extending across a little more than half the width of the case and with slight tapers at its edges to ensure clearance from the minor sides 13 and 14. The first major flap is thus folded into a base plane defined by the lower edges of the sides of the case.

FIG. 3 shows the situation after both minor flaps have been folded into the base plane. A key feature of each minor flap such as flap 17 is an edge 25 parallel to and substantially coincident with the free edge 26 of the first major flap. Each minor flap extends substantially from this edge 25 to the base of side 12 but with a slight taper to provide clearance. The opposite edge of each minor side is tapered as at 27 so as to provide for the edge 25. The angle of taper 27 is chosen to provide a substantial overlap between the first major flap and the minor flaps. In practice, the second minor flap is folded to the position shown before the first minor flap is folded. The sequence of folding the minor flaps is unimportant for operation of the carton because both flaps are to a certain extent independent.

The fourth major flap has tapered sides 28 running away from the base 12 and the flap then terminates in a tongue 29 which has a width corresponding to the distance between the extremities of edges 25 and which overlaps the first major flap 15. Tongue 29 has a slight reverse taper at its sides. The second major flap also overlaps the two minor flaps.

In order to interlock the four base flaps, it is necessary to pass tongue 29 through the gap defined between edges 25 of the minor flaps and edge 26 of the first major flap. This is carried out by moving the second major flap beyond the base plane into the carton until it flips past the edge 26 of the first major flap. During this movement, all four flaps tend to be moved into the case along with the second major flap and a degree of temporary bending occurs as the minor flaps are lifted up by the first major flap but have to remain below the second major flap. The material has sufficient resilience to cause all four flaps to fold back substantially into the base plane after the second major flap is released. The stiffness of the overlapping and interlocking flaps provides sufficient rigidity. The reverse taper on tongue 29 also helps the interlocking arrangement.

The case described above is conventional and the present invention is concerned with a machine for erecting this kind of case or a different design of case with interlocking major and minor flaps to form its base.

Figure 5:
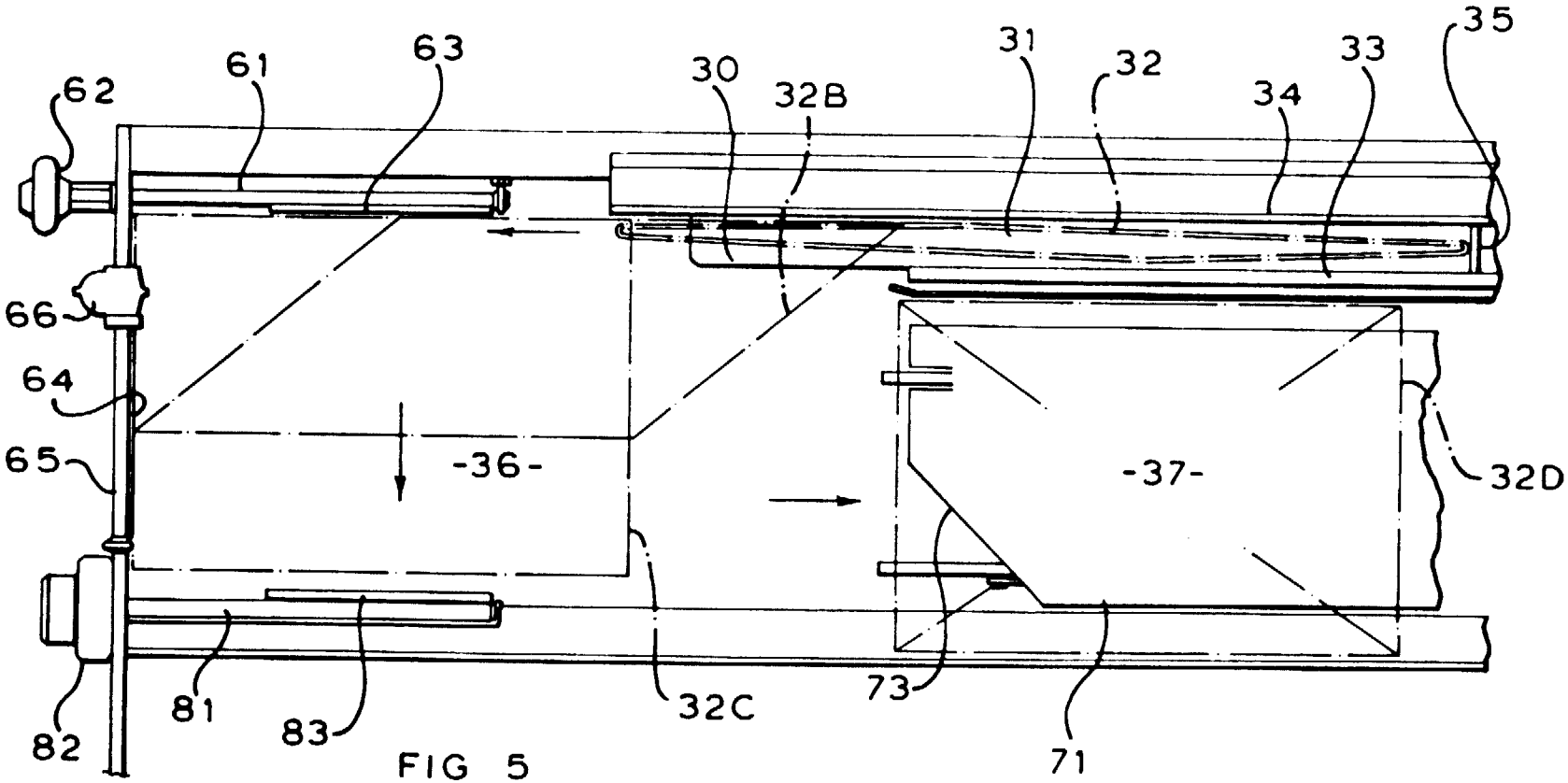
FIG. 5 is a diagrammatic representation of the layout of various stations in the machine.

FIG. 5 shows the basic layout of the machine, outlining the flow of cases through it. Relevant details will be described subsequently with reference to other drawings. A folded-case receiving station 31 with a folded case 32 shown in ghost is defined by a cradle 30 and fixed vertical guides 33 and 34. The folded case 32 is fed down vertically into the folded-case receiving station from a magazine by a feed mechanism which is not shown because it forms no part of the instant invention. A pneumatically driven pusher 35 is arranged to drive the cradle 30 supporting the folded case 32 to the left as shown in FIG. 5 for a purpose to be described. A first station or base-erecting station 36 is defined by a subsequent position of the case 32 in which it has taken on a rectangular form as represented by reference 32C. In order to indicate the opening of the carton to this rectangular form, a partially opened parallelogram representation of the case is shown at 32B. A case-opening carrier by which the case is opened to its rectangular form will be described subsequently with reference to FIGS. 6 to 8. Once in the base-closing station, the four base flaps are folded from their vertical position to a horizontal position to form the base in a manner which will be described subsequently with reference to FIG. 5 and FIGS. 9 to 11. On erection of the base, the case is filled with product and is then transferred to a second station 37 at which the case is represented in ghost by reference 32D. At the second station 37 the top of the case is closed so this second station will subsequently be referred to as the top closing station.

After closing the case at top closing station 33, the case is transferred to the right out of the drawing to a case stacking station to facilitate orderly removal of groups of cases from the machine. The case stacking and removal operation will not be described in detail because it does not form part of the instant invention.

FIGS. 6 to 8 show the mechanism for opening a folded flat case at the base erecting station 36. A flat case is positioned in the case receiving station 31 (FIG. 5) at which it is supported from below by its vertical base flaps. The flat case supported from below by cradle 30 is then pushed in a leftward direction by pusher 35 until it is almost clear of guide 33. At this stage, it has taken up a position as shown at 32A in a case opening mechanism 38 (FIG. 6). The case opening mechanism 38 lies directly over the first station 36 as shown in FIG. 5 but is above the level of the parts of mechanism shown in FIG. 5 and is left out of figure in the interests of clarity of illustration of other parts.

The case is then engaged by three side-supporting elements or case supports 41, 42 and 43 of the case opening mechanism, each of which is constituted by a pair of rubber suction members 44 connected to a source of vacuum and carried on a pivotal arm 45 as shown in FIG. 6B. Case supports 41 and 42 respectively engage the first and second major sides while case support 43 engages the second minor side. The first minor side remains unsupported. Once the flat case has been engaged by its case supports, the cradle 30 and pusher 35 are retracted, leaving the case supported entirely by its sides and leaving free space under it.

The case opening mechanism 38 and its operation will now be described with reference to FIGS. 6 to 8, primarily FIG. 7. Case opening mechanism 38 has a primary transverse member 39 which is in a relatively fixed position in so far as case opening is concerned. Case support 42 for the second major side 12 is carried on a slide 52 which moves laterally of transverse member 39, contributing to opening of the case as shown. Case support 41 is carried on a member 53 which is free to slide longitudinally with respect to transverse member 39. Member 53 is driven by a link 54 connected between member 53 and slide 52 so that movement of member 53 is co-ordinated with movement in a lateral direction of slide 52. A pneumatically powered actuating lever 55 provides power for this mechanism. Case support 43 is in turn carried from slide 52 by an arm 56 pivoted as closely as possible to the effective hinge point 57 of the case. This mechanism described with reference to FIG. 7 thus opens the case from the folded position 32A of FIG. 6A, through the parallelogram position 32B shown in FIG. 7 to the fully open rectangular position 32C shown in FIG. 8.

Figure 9:
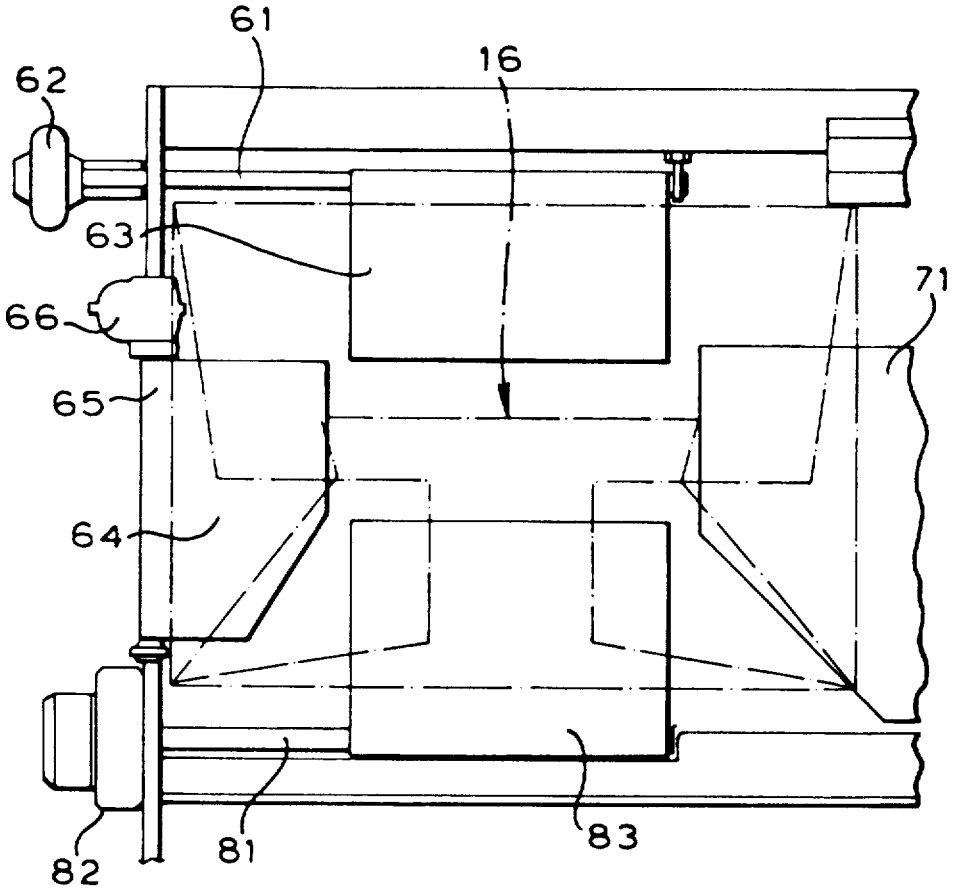
FIGS. 9 to 11 are details illustrating elements for closing the bottom of the case.

Three flap folding elements for three of the base flaps are shown in both FIGS. 5 and 9. In FIG. 5 they are shown in the positions they occupy before flap folding while FIG. 9 shows the positions after flap folding.

A first flap folding element 63 for the first major flap 26 is formed as a flat plate secured to a spindle 6 driven to rotate about its own axis by pneumatic motor 62. As plate 63 moves from the position shown in FIG. 5 to that shown in FIG. 9, the first major flap 26 is raised from a vertical to a horizontal position.

A second flap folding element 64 carried on a spindle 65 is driven by pneumatic motor 66 from a vertical to a horizontal position in a similar way to bring the second minor flap 18 from its vertical to its horizontal position as shown in FIG. 9.

Figure 10:
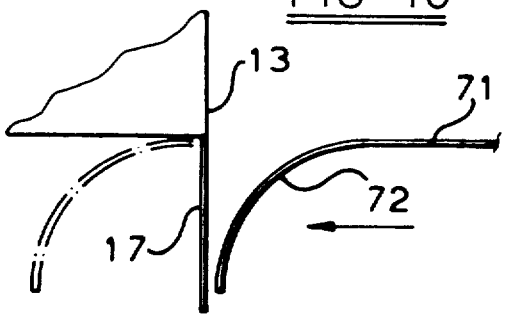

As previously explained, the first minor flap 17 does not have a flap folding element of the same kind as is provided for the other flaps. Instead, a case support carriage 71 intended primarily for transferring cases from the first station 36 to the second station 37 by longitudinal movement also serves to fold the first minor flap 17. The leading edge of case support carriage 71 is a guide which is curved downwards in the form of a plough 72 as illustrated in FIG. 10. As the carriage is traversed towards the base closing station 36, the plough engages with the flap 17 and folds it up into a horizontal position. The carriage and in particular the plough section of it are cut away at 73 to provide clearance for other parts of the mechanism to be described.

Figure 11:
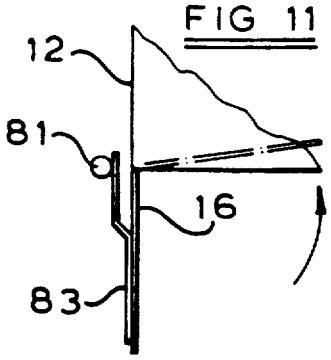

A third flap folding element 83 pivots on spindle 81 and is rotated between the vertical position of FIG. 5 and the horizontal position of FIG. 9 by a pneumatic motor 82. FIG. 11 is a scrap cross sectional view showing further features of the third flap closing element and in particular that it is capable of rotating beyond the horizontal position.

The sequence of operation of the flap closing elements in order to close the flaps into a base must conform to the sequence as explained with reference to FIGS. 1 to 4. Thus, the first major flap 26 is the first flap to be folded. Secondly, the second minor flap 18 and first minor flap 17 are folded simultaneously or either one immediately after the other by the folding element 64 and the plough 72 respectively. Flap folding element 83 is then operated to bring the second major flap to and beyond the horizontal position through sufficient angle to lock the flaps of the carton together. It is important that the plough 72 on carriage 71 either comes to rest or moves sufficiently slowly in relation to other parts of the mechanism to enable other operations to be carried out. All three flap folding elements 63, 64 and 83 are then retracted to their vertical positions. Throughout this period of time, the case remains supported on the case support elements 41, 42 and 43.

The underside of the case when free of the flap folding elements can receive the case support carriage 71 which continues its traverse to take up a position at the first station 36 where it supports the weight of the case.

The case is then filled with product from above by a mechanism which is not shown because it forms no part of the instant invention. During or immediately after filling, the case supports 41, 42 and 43 are retracted to leave the case supported solely on its case support carriage 71.

Remaining activity carried out in the machine is conventional but will be described briefly for the sake of completeness. The transfer carriage is then moved back to carry the case with it to the top closing station 37 shown in FIG. 5. The mechanism of FIGS. 6, 7 and 8 is returned to the position shown in FIG. 6, ready to engage another case for repetition of the cycle. At case closing station 37 the case can then be closed by any convenient mechanism at the same time as the next empty case is being opened, has its base erected and is filled with product.

The base erection station 36 is offset laterally to a small extent from the top closing station 37 as illustrated by the positions of the case at 32C and 32D in FIG. 5. This arrangement allows folded cases from the folded-case receiving station 31 to be traversed directly to the base erection station 36 while the top closing station 37 is offset beside the folded-case receiving station 31. To compensate for this offset, the whole case opening mechanism 38 is moved laterally with transverse member 39 after the base has been erected to bring the case into alignment with the top closing station 37 while the case is supported on the case support carriage 71.

I CLAIM

1. A machine for erecting packing cases of a kind comprising first and second major sides, first and second minor sides and a respective base flap associated with each of said sides whereby said flaps are foldable to form a base for the case; the machine comprising: a first case station; a second case station adjacent the first station; means for supporting a folded flat case by its sides and for opening its sides to a rectangular form with the case at the first station and with a first minor side of the case adjacent the second station; a first flap folding element at the first station arranged to fold the first major flap into the base plane; a second flap folding element at the first station arranged to fold the second minor flap into the base plane; a carriage traversable between the two stations for transferring the case from the first station to the second station and having a guide on the carriage arranged to engage the first minor flap as the carriage moves towards the first station and to deflect the first minor flap into the base plane and a third flap folding element arranged to engage the second major flap after the folding of the minor flaps and without interference with the carriage to fold the second major flap through the base plane and up into the case to cause interlocking engagement of the flaps and then to retract to allow the second major flap to return to the base plane; the flap folding elements being retractable to allow the carriage to continue to move under the case to support the base thereof.

2. A machine according to claim 1 wherein the means for supporting a folded flat case by its sides and for opening its sides comprise side supporting elements having suction members for engagement with said sides.

3. A machine according to claim 1 further comprising a folded case receiving station remote from the first station and adjacent the second station and means for traversing the folded flat case to the first station for engagement with said means for supporting the case by its sides.

4. A machine according to claim 1 wherein said guide comprises a curved leading edge to said carriage as it traverses to the first station.

* * * * *